US009074427B2

(12) United States Patent
Tan et al.

(10) Patent No.: US 9,074,427 B2
(45) Date of Patent: Jul. 7, 2015

(54) RISER ASSEMBLY AND METHOD

(75) Inventors: Zhimin Tan, Houston, TX (US); Yanqiu Zhang, Houston, TX (US); Lun Qiu, Houston, TX (US)

(73) Assignee: GE Oil & Gas UK Limited, Nailsea, Bristol (GB)

( * ) Notice: Subject to any disclaimer, the term of this patent is extended or adjusted under 35 U.S.C. 154(b) by 0 days.

(21) Appl. No.: 13/882,921

(22) PCT Filed: Oct. 25, 2011

(86) PCT No.: PCT/GB2011/052071

§ 371 (c)(1), (2), (4) Date: Jul. 19, 2013

(87) PCT Pub. No.: WO2012/063036

PCT Pub. Date: May 18, 2012

(65) Prior Publication Data

US 2013/0292129 A1 Nov. 7, 2013

Related U.S. Application Data

(60) Provisional application No. 61/411,833, filed on Nov. 9, 2010.

(51) Int. Cl.
*E21B 17/01* (2006.01)

(52) U.S. Cl.
CPC ..... *E21B 17/012* (2013.01); *E21B 17/015* (2013.01)

(58) Field of Classification Search
CPC . E21B 17/015; E21B 17/012; E21B 43/0107; E21B 43/013; F16L 1/24
USPC ..... 166/350, 367, 346; 405/171, 172, 405/184.4, 224.2, 224.3; 441/3–5, 23, 133
See application file for complete search history.

(56) References Cited

U.S. PATENT DOCUMENTS

| | | | | | |
|---|---|---|---|---|---|
| 4,056,944 | A | * | 11/1977 | Lamy | 405/170 |
| 4,063,430 | A | * | 12/1977 | Lamy | 405/171 |
| 4,065,822 | A | * | 1/1978 | Wilbourn | 441/4 |
| 4,107,933 | A | * | 8/1978 | Lamy | 405/171 |
| 4,135,844 | A | * | 1/1979 | Lamy | 405/171 |
| 4,159,189 | A | * | 6/1979 | Todd et al. | 405/169 |
| 4,183,697 | A | * | 1/1980 | Lamy | 405/170 |

(Continued)

FOREIGN PATENT DOCUMENTS

| | | | |
|---|---|---|---|
| CN | 1294654 | A | 5/2001 |
| CN | 1312881 | A | 9/2001 |

(Continued)

OTHER PUBLICATIONS

International Preliminary Report on Patentability dated May 23, 2013, for corresponding International Application No. PCT/GB2011/052071, 6 pages.

(Continued)

*Primary Examiner* — Matthew Buck
(74) *Attorney, Agent, or Firm* — Shumaker & Sieffert, P.A.

(57) ABSTRACT

A riser assembly and method for transporting fluids from a sub-sea location are disclosed. The riser assembly includes a riser comprising at least one segment of flexible pipe; at least one buoyancy element for providing a positive buoyancy to a portion of the riser; and a tethering element for tethering the buoyancy element to a fixed structure and to resist the positive buoyancy of the buoyancy element.

14 Claims, 6 Drawing Sheets

(56) References Cited

U.S. PATENT DOCUMENTS

| | | | | |
|---|---|---|---|---|
| 4,263,004 | A * | 4/1981 | Joubert et al. | 405/172 |
| 4,301,840 | A * | 11/1981 | Jansen | 141/98 |
| 5,427,046 | A * | 6/1995 | Brown et al. | 114/230.13 |
| 5,505,560 | A * | 4/1996 | Brown et al. | 405/195.1 |
| 5,615,977 | A * | 4/1997 | Moses et al. | 405/195.1 |
| 5,944,448 | A * | 8/1999 | Williams | 405/169 |
| 6,146,052 | A * | 11/2000 | Jacobsen et al. | 405/169 |
| 6,200,180 | B1 * | 3/2001 | Hooper | 441/5 |
| 6,206,742 | B1 * | 3/2001 | Bull et al. | 441/1 |
| 6,364,022 | B1 * | 4/2002 | Kodaissi et al. | 166/367 |
| 7,025,533 | B1 * | 4/2006 | Mungall et al. | 405/158 |
| 7,287,936 | B2 * | 10/2007 | Streiff et al. | 405/224.2 |
| 8,517,044 | B2 * | 8/2013 | Pollack et al. | 137/236.1 |
| 2005/0158126 | A1 * | 7/2005 | Luppi | 405/224.2 |
| 2007/0081862 | A1 * | 4/2007 | Wolbers et al. | 405/169 |
| 2008/0196899 | A1 | 8/2008 | Alliot | |
| 2008/0317555 | A1 * | 12/2008 | De Aquino et al. | 405/195.1 |
| 2009/0269141 | A1 * | 10/2009 | Li et al. | 405/169 |
| 2010/0034594 | A1 * | 2/2010 | Major | 405/219 |
| 2011/0129305 | A1 * | 6/2011 | Withall et al. | 405/224.2 |
| 2011/0155383 | A1 * | 6/2011 | Christiansen et al. | 166/345 |
| 2011/0226484 | A1 * | 9/2011 | Lavagna | 166/367 |

FOREIGN PATENT DOCUMENTS

| | | | |
|---|---|---|---|
| CN | 101517165 | A | 8/2009 |
| GB | 2306608 | A | 5/1997 |
| WO | 2005103436 | A1 | 11/2005 |
| WO | 2008036728 | A2 | 3/2008 |
| WO | 2009063163 | A1 | 5/2009 |
| WO | 2010030160 | A1 | 3/2010 |

OTHER PUBLICATIONS

International Search Report for corresponding PCT Application No. PCT/GB2011/052071, dated May 15, 2012 (5 pages).

Written Opinion for corresponding PCT Application No. PCT/GB2011/052071, dated May 15, 2012 (5 pages).

Examination Report and Search Report for corresponding China Application No. 2011800536757 dated Aug. 4, 2014, 7 pgs.

Examination Report for counterpart European Patent Application No. 11779201.0-1605 dated Sep. 26, 2014, 5 pgs.

* cited by examiner

RISER ASSEMBLY AND METHOD

The present invention relates to a method and apparatus for providing a riser assembly including one or more buoyancy modules. In particular, but not exclusively, the present invention relates to a riser assembly suitable for use in the oil and gas industry, providing enhanced support to the buoyancy modules to help prevent unwanted movement after installation.

Traditionally flexible pipe is utilised to transport production fluids, such as oil and/or gas and/or water, from one location to another. Flexible pipe is particularly useful in connecting a sub-sea location to a sea level location. Flexible pipe is generally formed as an assembly of a pipe body and one or more end fittings. The pipe body is typically formed as a composite of layered materials that form a pressure-containing conduit. The pipe structure allows large deflections without causing bending stresses that impair the pipe's functionality over its lifetime. The pipe body is generally built up as a composite structure including metallic and polymer layers.

In known flexible pipe design the pipe includes one or more tensile armour layers. The primary load on such a layer is tension. In high pressure applications, the tensile armour layer experiences high tension loads from the internal pressure end cap load as well as weight. This can cause failure in the flexible pipe since such conditions are experienced over prolonged periods of time.

One technique which has been attempted in the past to in some way alleviate the above-mentioned problem is the addition of buoyancy aids at predetermined locations along the length of a riser. Employment of buoyancy aids involves a relatively lower installation cost compared to some other configurations, such as a mid-water arch structure, and also allows a relatively faster installation time. Examples of known riser configurations using buoyancy aids to support the riser's middle section are shown in FIGS. 1*a* and 1*b*, which show the 'steep wave' configuration and the 'lazy wave' configuration, respectively. In these configurations, there is provided a riser assembly 200 suitable for transporting production fluid such as oil and/or gas and/or water from a subsea location to a floating facility 202 such as a platform or buoy or ship. The riser is provided as a flexible riser, i.e., including a flexible pipe, and includes discrete buoyancy modules 204 affixed thereto. The positioning of the buoyancy modules and flexible pipe can be arranged to give a steep wave configuration $\mathbf{206}_1$ or a lazy wave configuration $\mathbf{206}_2$.

However, in some applications, the buoyancy modules may react to changes in riser assembly weight, for example caused by marine growth (shellfish and other sea life and/or sea debris attaching to the riser). Alternatively or additionally, the buoyancy modules may experience a gradual (or sudden) change in content density due to movement or general day to day wear. This may cause the amount of buoyancy support (and therefore the relative height above the sea bed) of the riser to change. Any change in the amount of buoyancy support may have an adverse effect on the tension relief provided to the flexible pipe, which could ultimately decrease the lifetime of a riser.

Furthermore, such changes in weight could lead to an undesirable situation where the riser assembly diverts completely from its designated configuration by either popping up to the water's surface or sinking to the seabed. This is particularly applicable to shallow water applications (less than 1000 feet (304.8 meters)), since any change in buoyancy has a more pronounced effect on the height change at shallow depths. Interference with any neighbouring riser assemblies or vessel structures could become a problem.

It is an aim of the present invention to at least partly mitigate the above-mentioned problems.

It is an aim of embodiments of the present invention to provide a riser assembly and method for manufacturing a riser assembly able to operate in water depths of about 1000 feet (304.8 meters).

It is an aim of embodiments of the present invention to provide a riser assembly to which buoyancy modules can be secured or are included integrally so as to provide the advantages of a buoyed riser, without the disadvantages associated with variations in riser weight.

According to a first aspect of the present invention there is provided a riser assembly for transporting fluids from a subsea location, comprising: a riser comprising at least one segment of flexible pipe; at least one buoyancy element for providing a positive buoyancy to a portion of the riser; and a tethering element for tethering the buoyancy element to a fixed structure and to resist the positive buoyancy of the buoyancy element.

According to a second aspect of the present invention there is provided a method of supporting a flexible pipe, the method comprising the steps of: providing a riser comprising at least one segment of flexible pipe; providing at least one buoyancy element for providing a positive buoyancy to a portion of the riser; and providing a tethering element for tethering the buoyancy element to a fixed structure and resisting the positive buoyancy of the buoyancy element.

Certain embodiments of the invention provide the advantage that enhanced support is provided to the buoyancy elements to help prevent unwanted movement of the buoyancy elements after installation. This leads to improved overall riser performance.

Certain embodiments of the invention provide the advantage that a riser assembly is provided that is far less sensitive to changing riser weight.

Certain embodiments of the invention provide the advantage that a riser assembly is provided that can be installed relatively quickly and at relatively low cost compared to known configurations.

BRIEF DESCRIPTION OF THE DRAWINGS

Embodiments of the invention are further described hereinafter with reference to the accompanying drawings, in which.

DETAILED DESCRIPTION

Figure 1A:
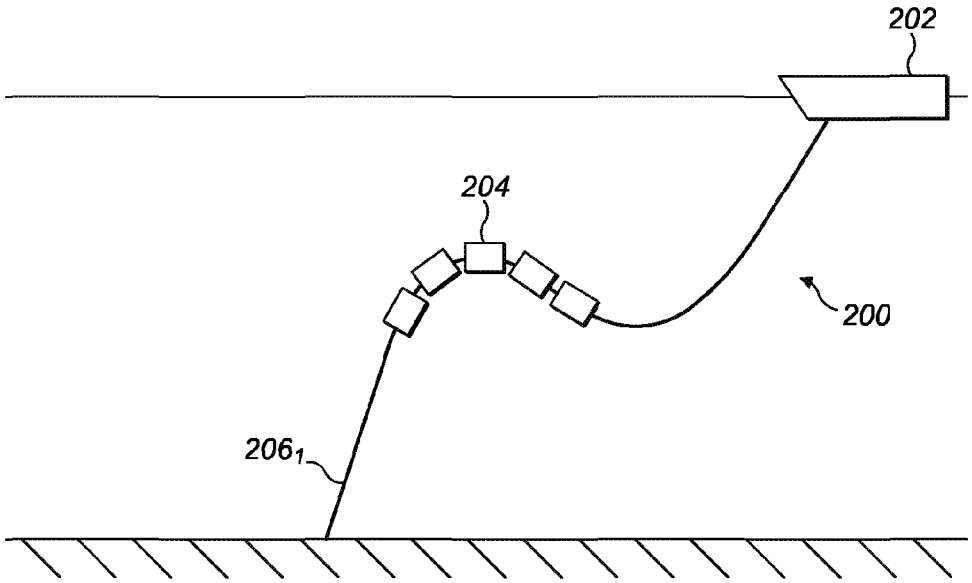
FIG. 1*a* illustrates a known riser assembly.
Figure 1B:
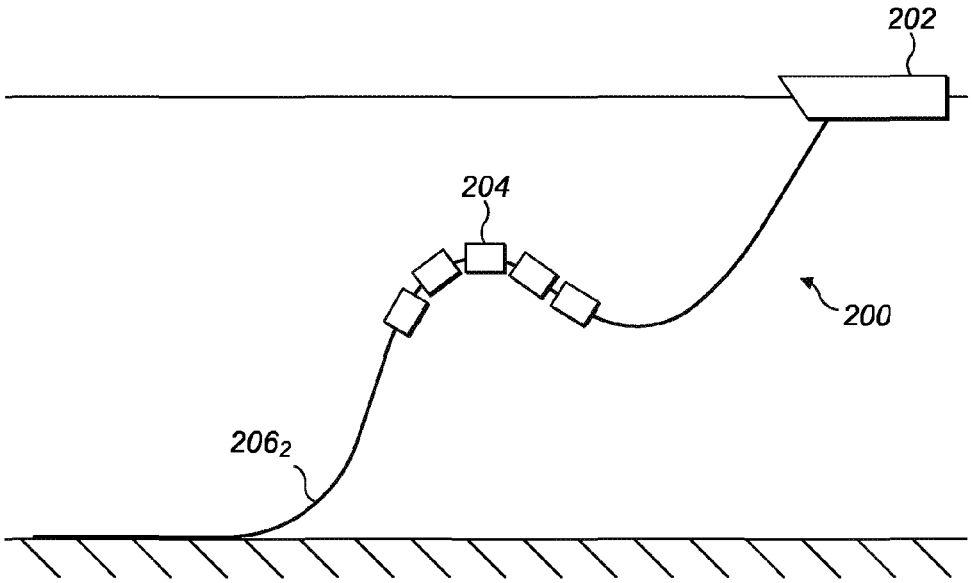
FIG. 1*b* illustrates another known riser assembly.

In the drawings like reference numerals refer to like parts.

Figure 2:
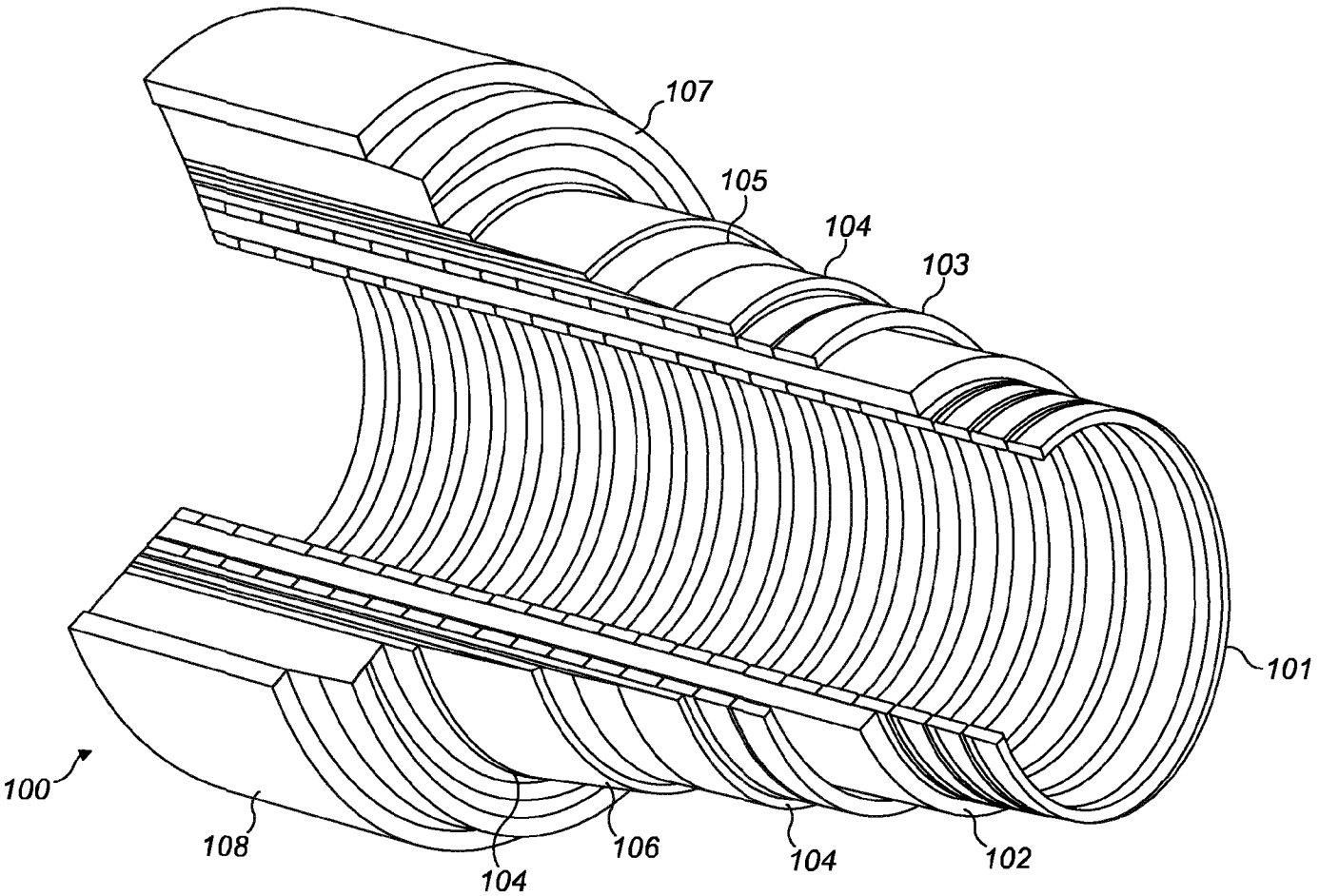
FIG. 2 illustrates a flexible pipe body.

Throughout this description, reference will be made to a flexible pipe. It will be understood that a flexible pipe is an assembly of a portion of a pipe body and one or more end fittings in each of which a respective end of the pipe body is terminated. FIG. 2 illustrates how pipe body 100 is formed in accordance with an embodiment of the present invention from a composite of layered materials that form a pressure-containing conduit. Although a number of particular layers are illustrated in FIG. 2, it is to be understood that the present invention is broadly applicable to composite pipe body structures including two or more layers manufactured from a variety of possible materials. It is to be further noted that the layer thicknesses are shown for illustrative purposes only.

As illustrated in FIG. 2, a pipe body includes an optional innermost carcass layer 101. The carcass provides an interlocked construction that can be used as the innermost layer to prevent, totally or partially, collapse of an internal pressure sheath 102 due to pipe decompression, external pressure, and tensile armour pressure and mechanical crushing loads. It will be appreciated that certain embodiments of the present invention are applicable to 'smooth bore' as well as such 'rough bore' applications.

The internal pressure sheath 102 acts as a fluid retaining layer and comprises a polymer layer that ensures internal fluid integrity. It is to be understood that this layer may itself comprise a number of sub-layers. It will be appreciated that when the optional carcass layer is utilised the internal pressure sheath is often referred to by those skilled in the art as a barrier layer. In operation without such a carcass (so-called smooth bore operation) the internal pressure sheath may be referred to as a liner.

An optional pressure armour layer 103 is a structural layer with a lay angle close to 90° that increases the resistance of the flexible pipe to internal and external pressure and mechanical crushing loads. The layer also structurally supports the internal pressure sheath.

The flexible pipe body also includes an optional first tensile armour layer 105 and optional second tensile armour layer 106. Each tensile armour layer is a structural layer with a lay angle typically between 20° and 55°. Each layer is used to sustain tensile loads and internal pressure. The tensile armour layers are typically counter-wound in pairs.

The flexible pipe body shown also includes optional layers 104 of tape which help contain underlying layers and to some extent prevent abrasion between adjacent layers.

The flexible pipe body also typically includes optional layers of insulation 107 and an outer sheath 108 which comprises a polymer layer used to protect the pipe against penetration of seawater and other external environments, corrosion, abrasion and mechanical damage.

Each flexible pipe comprises at least one portion, sometimes referred to as a segment or section of pipe body 100 together with an end fitting located at at least one end of the flexible pipe. An end fitting provides a mechanical device which forms the transition between the flexible pipe body and a connector. The different pipe layers as shown, for example, in FIG. 2 are terminated in the end fitting in such a way as to transfer the load between the flexible pipe and the connector.

Figure 3:
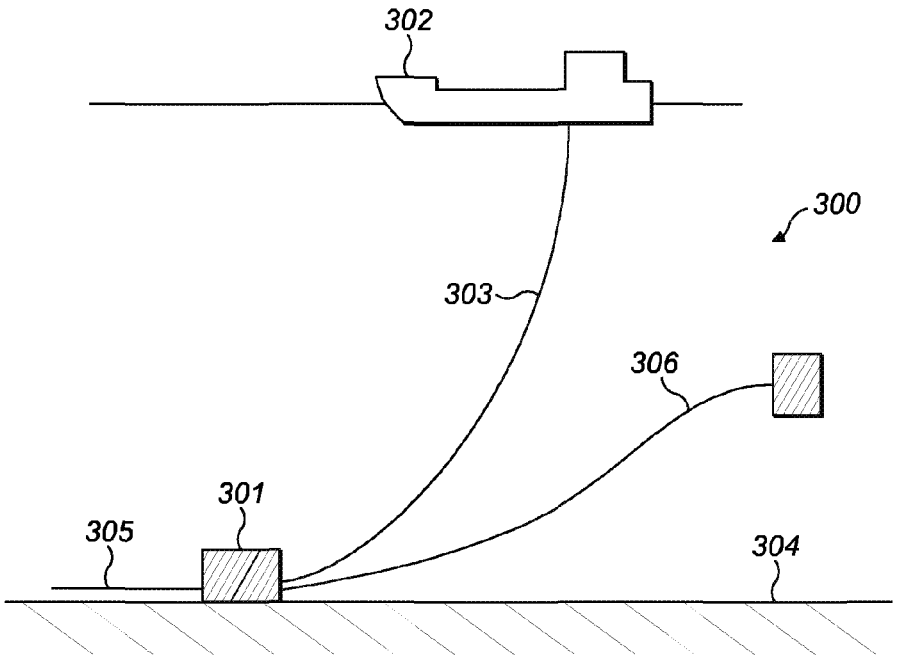
FIG. 3 illustrates another riser assembly.

FIG. 3 illustrates a riser assembly 300 suitable for transporting production fluid such as oil and/or gas and/or water from a sub-sea location 301 to a floating facility 302. For example, in FIG. 3 the sub-sea location 301 includes a sub-sea flow line. The flexible flow line 305 comprises a flexible pipe, wholly or in part, resting on the sea floor 304 or buried below the sea floor and used in a static application. The floating facility may be provided by a platform and/or buoy or, as illustrated in FIG. 3, a ship. The riser 300 is provided as a flexible riser, that is to say a flexible pipe connecting the ship to the sea floor installation.

It will be appreciated that there are different types of riser, as is well-known by those skilled in the art. Embodiments of the present invention may be used with any type of riser, such as a freely suspended (free, catenary riser), a riser restrained to some extent (buoys, chains), totally restrained riser or enclosed in a tube (I or J tubes).

FIG. 3 also illustrates how portions of flexible pipe body can be utilised as a flow line 305 or jumper 306.

Figure 4:
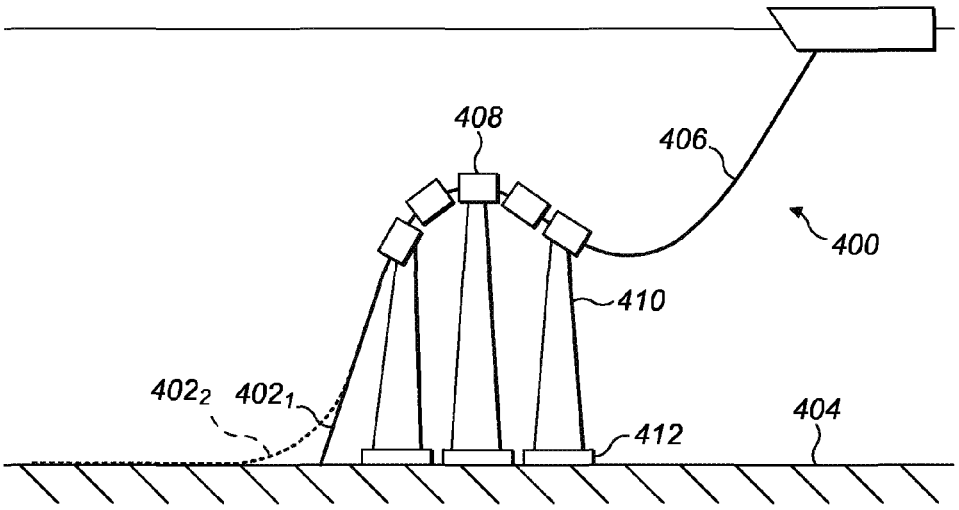
FIG. 4 illustrates a riser assembly of the present invention.

FIG. 4 illustrates a riser assembly 400 of the present invention, which could be provided in a steep $\mathbf{402}_1$ or lazy $\mathbf{402}_2$ form, according to for example the riser arrangement at the seabed 404 touchdown area. The riser assembly 400 includes a riser 406 which may be comprised of at least one segment of flexible pipe, i.e., one or more sections of flexible pipe body, and one or more end fittings in each of which a respective end of the pipe body is terminated. The riser assembly also includes one or more buoyancy element 408 such as a buoyancy module or buoyancy aid. In the example shown in FIG. 4, five buoyancy elements are shown. Of course, it will be clear that fewer or more buoyancy elements may be employed to suit the requirements of the specific situation.

The riser assembly 400 further includes one or more tethering element 410 which could be a chain, rope or other restraining aid. The tethering element 410 tethers a buoyancy element 408 to a fixed structure, which in this example is an anchor weight 412 located on the seabed 404. Again, it will be appreciated that whilst the example of FIG. 4 shows tethering elements that tether three of the five buoyancy modules to three anchor weights, respectively, other numbers of tethering elements may be used, and the ratio of tethers to buoyancy elements may be changed, according to the requirements of the situation. For example, each buoyancy element provided may be tethered, or fewer buoyancy elements may be tethered. The buoyancy elements may be secured to the riser or integrally formed with the riser.

By providing the tethering elements, this helps to support and fix the location of the buoyancy element, so as to help prevent movement of the buoyancy element after the riser assembly has been installed. This will reduce the chance of the buoyancy element interfering with any neighbouring riser or vessel structure, for example.

In the present embodiment, the buoyancy elements 408 have increased buoyancy compared to those used in prior known configurations. This could be achieved, for example, by using larger buoyancy elements, or by providing more buoyancy elements, compared to known ways. As such, the increased buoyancy creates an upward force on the riser, which would tend to cause the riser assembly to be positively buoyant at that section of the riser. It will be understood that neutral buoyancy causes an object to remain at the same height above sea level without moving upward or downwards, negative buoyancy effectively causes an object to sink, and positive buoyancy causes an object to rise up toward the surface of the water.

However, the tether elements 410 resist the positive buoyancy of the buoyancy elements 408 by providing an opposite force to the upward force of the buoyancy elements. That is, the tethering elements 410 pull against the force of the buoyancy elements 408. Thereby, tethering elements are in constant tension, and the height above the seabed of the buoyancy elements and the riser assembly is generally fixed. Of course, the tethered arrangement also helps to fix the position of the buoyancy elements in all other directions.

With the above-described arrangement, the forces being exerted by the buoyancy elements and the tethering elements fixed to the anchor weights effectively counteract each other, with the tethering element in constant tension. Therefore, changes that might offset the overall buoyancy of the riser assembly, such as additional weight caused by marine growth, or a change of the content density of the buoyancy elements over time, are not influential on the position of the buoyancy elements, and thus the position of the riser. That is, even if the downward force or weight of the riser assembly increases, there is sufficient upward force from the buoyancy elements to ensure that the tether remains in tension and the position of the riser assembly generally does not change. The amount of tension on the tethering element may reduce over time, but is predetermined to remain at a sufficient degree of tension, even when the riser assembly reaches the heaviest weight due to marine growth, and/or other buoyancy-affecting factors noted above.

Figure 5:
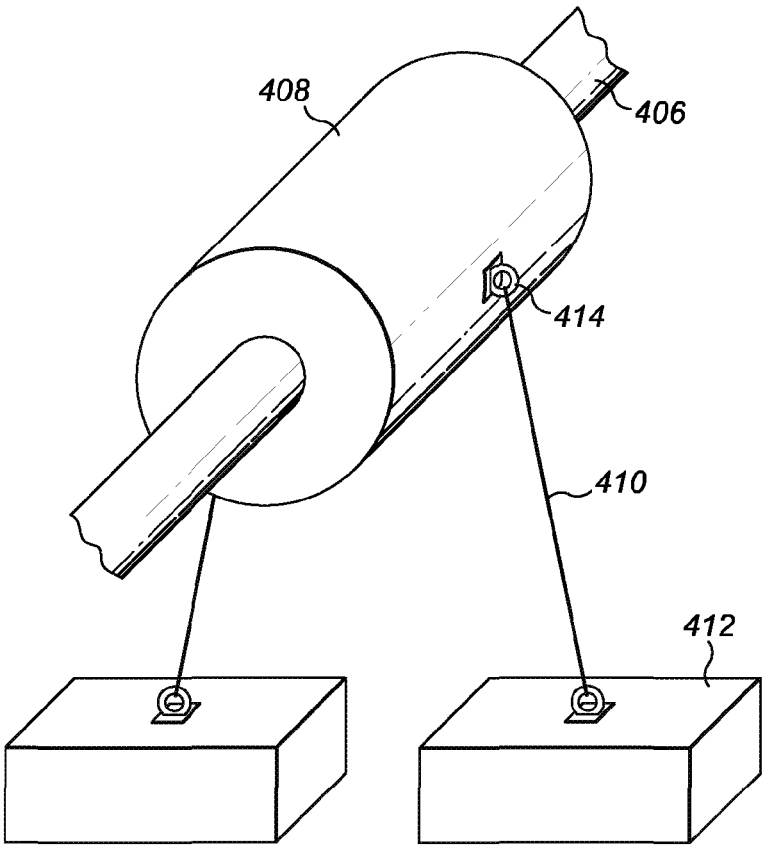
FIG. 5 illustrates a further view of the riser assembly of FIG. 4.

FIG. 5 illustrates a further view of the riser assembly 400 with a buoyancy element 408 connected to a section of riser 406 and a tethering element 410 fastening the buoyancy element to anchor weights 412. Although the example shown illustrates the tethering elements 410 to be tied via ring members 414 to the buoyancy element 408 and anchor weights 412, it will be clear that any suitable fixing technique could be used. For example, a single rope could be affixed so as to have a central portion lying over the upper surface of the buoyancy element and end portions extending away to be fixable to an anchor. It will also be clear that the tether element described could be fully or at least partly flexible, whilst enabling it to act under tension.

Figure 6:
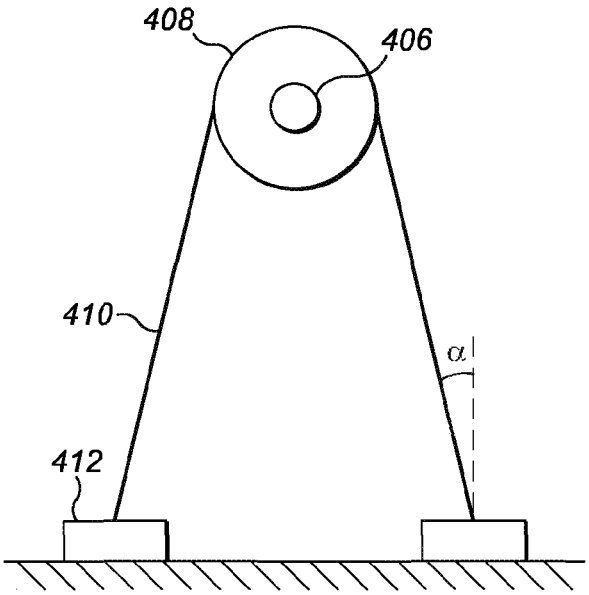
FIG. 6 illustrates a front view of the riser assembly of FIG. 4.

FIG. 6 illustrates a yet further view of the riser assembly 400 showing a cross-section through the circular section of the riser 406 and buoyancy element 408. The view shows a plane that dissects the longitudinal axis of the riser, herein known as a front view. In the present embodiment, the tethering elements 410 are provided at an apparent angle of between 20 and 40 degrees from vertical, as signified by an apparent angle $\alpha$. By providing the tethering elements at this angle gives a particularly stable tethering arrangement.

Figure 7:
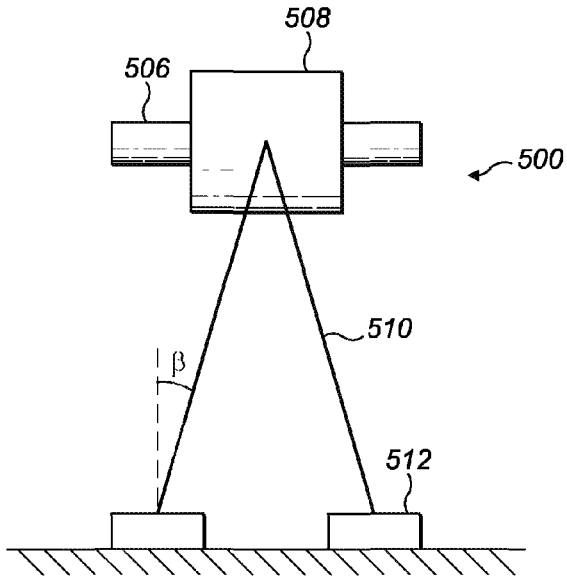
FIG. 7 illustrates a side view of an embodiment of the invention.

A further embodiment of the present invention is illustrated in FIG. 7 showing a side view of a riser assembly 500. The riser assembly 500 is similar in many respects to the riser assembly 400 of FIG. 4. However, in this embodiment, there are a total of four tethering elements 510 (of which two are shown in the side view of FIG. 7). The tethering elements 510 may be tethered to the buoyancy element 508 and anchor weights 512 in the same manner as the previous embodiment using ring members, or in any other way. In the present embodiment, the tethering elements 510 are provided at an angle of between 5 and 15 degrees from vertical, as signified by an apparent angle $\beta$.

In this embodiment, the tethering elements 510 are provided at an apparent angle of between 5 and 15 degrees from vertical, when viewing from a side direction, i.e., a plane perpendicular to the plane shown in FIG. 6. The tethering elements may additionally be provided at an apparent angle of between 20 and 40 degrees from vertical in the front direction, as per FIG. 6. It will be clear to a skilled person that tethers configured at such apparent angles will actually form a further, different angle in a plane that includes vertical and the tether. This arrangement gives a particularly stable tethering arrangement, giving both axial and lateral structural support to the configuration. The arrangement also minimises any interference with neighbouring risers and vessel structures.

Figure 8:
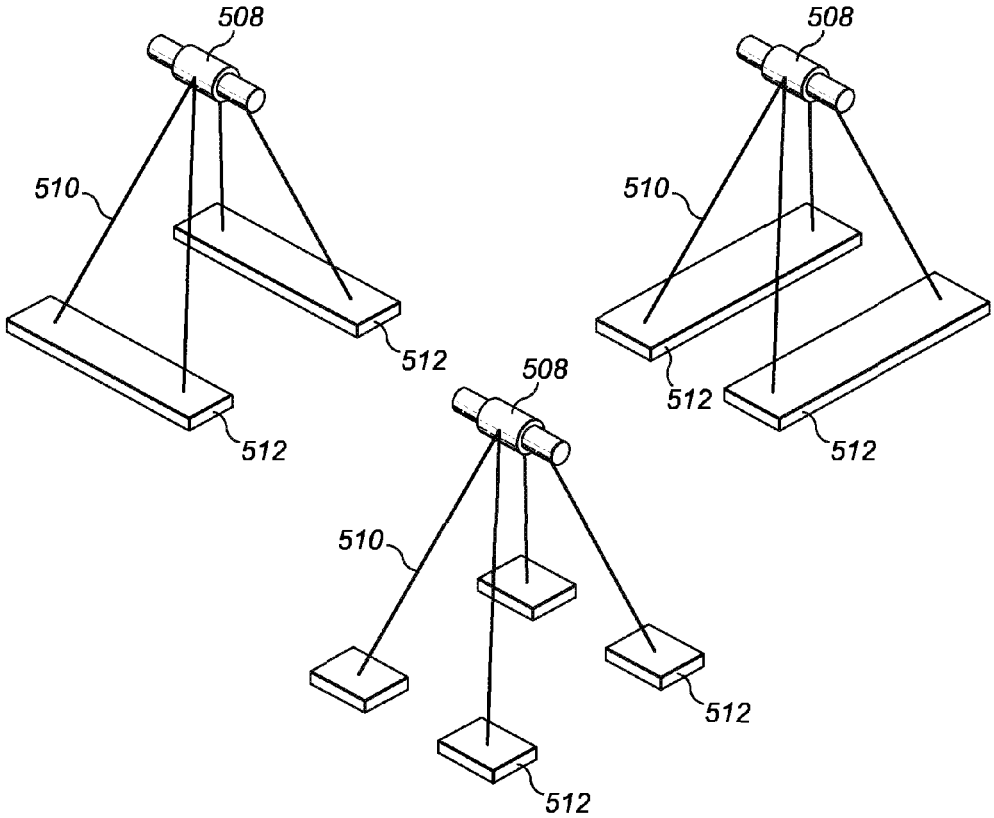
FIG. 8 illustrates examples of the present invention.

FIG. 8 shows various examples of how anchor weights 512 could be arranged. The tether tension requirements and/or dynamic response of the riser or tether may determine the type of arrangement that best suits the application. The anchor weights 512 or other fixed structure may be located directly on the seabed or may be built on pile foundations, or other such structure.

Figure 9:
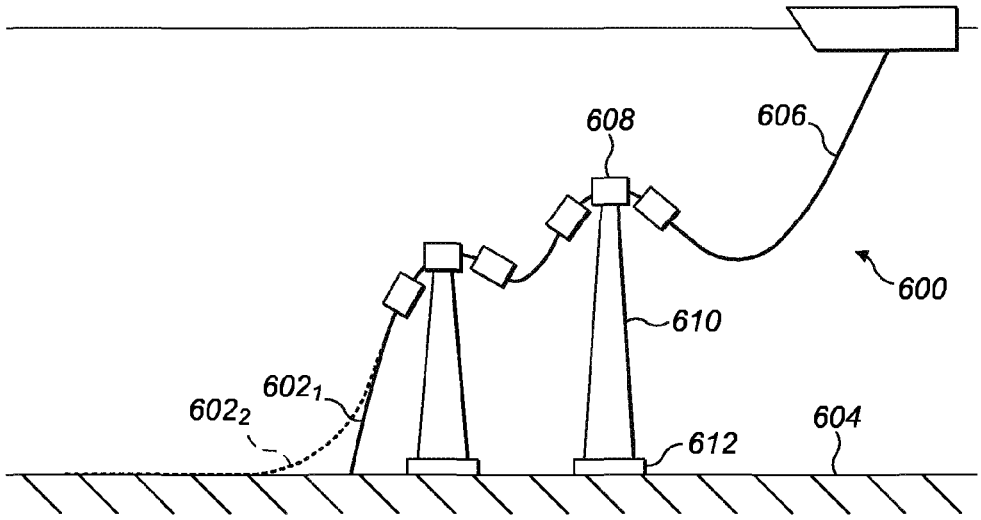
FIG. 9 illustrates a further embodiment of the present invention.

A yet further embodiment of the present invention is shown in FIG. 9. The riser assembly 600, which could be provided in a steep $\mathbf{602}_1$ or lazy $\mathbf{602}_2$ form, according to for example the riser arrangement at the seabed 604 touchdown area. The riser assembly 600 includes a riser 606 which may be comprised of at least one segment of flexible pipe, and one or more end fittings in each of which a respective end of the pipe body is terminated. The riser assembly also includes one or more buoyancy element 608, tethered to an anchor weight 612 by tether elements 610, in a similar manner to the embodiments described above. In this embodiment, the buoyancy elements 608 and tether elements 610 are arranged so as to form a kind of 'double wave' configuration. Such configuration may be useful for particular applications. It will be realised that any of the modifications described above could also be applicable to the present configuration.

Figure 10:
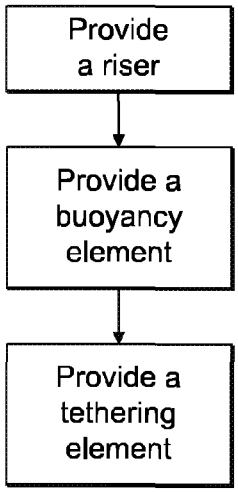
FIG. 10 illustrates a method of the present invention.

A method of supporting a flexible pipe of the present invention includes providing a riser comprising at least one segment of flexible pipe; providing at least one buoyancy element for providing a positive buoyancy to a portion of the riser; and providing a tethering element for tethering the buoyancy element to a fixed structure and resisting the positive buoyancy of the buoyancy element, for example as schematically shown in the flow chart of FIG. 10. Of course the steps can be performed in any order to suit the requirements of the application.

Figure 11:
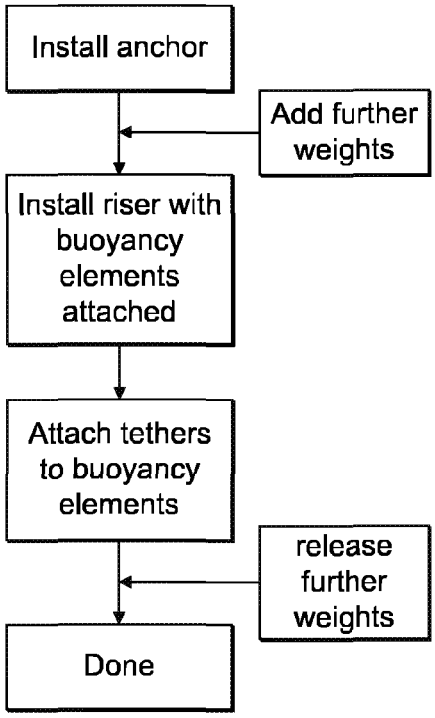
FIG. 11 illustrates a further method of the present invention.

In a further specific embodiment of the invention, a method of installing a riser assembly is shown schematically in the flow chart of FIG. 11. The method includes firstly placing one or more anchor weights in a desired location. Then, the riser is installed having buoyancy elements already attached to at least one buoyancy element. Optionally, additional weights can be attached to buoyancy modules prior to deployment, as an aid when attaching the tethers, so that the riser sinks to the desired position once deployed. Then, divers or a remotely operated underwater vehicle (ROV) can attach tethers to the buoyancy modules once deployment is complete. Any additional weights can then be released. Again, certain steps need not be performed in the order described.

With the invention described above, enhanced support is provided to the buoyancy elements to help prevent unwanted movement of the buoyancy elements after installation. This leads to improved overall riser performance. These arrangements give a stable tethering arrangement, giving both axial and lateral structural support to the configuration. The arrangements may also minimise any interference with neighbouring risers and vessel structures. In addition, a riser assembly is provided that is far less sensitive to changing riser weight. The assembly can be installed relatively quickly and at relatively low cost compared to known configurations.

The tethering elements help to support and fix the location of the buoyancy element, so as to help prevent movement of the buoyancy element after the riser assembly has been installed. Changes that might offset the overall buoyancy of the riser assembly, such as additional weight caused by marine growth, or a change of the content density of the buoyancy elements over time, are not influential on the position of the buoyancy elements, and thus the position of the riser.

It will be clear to a person skilled in the art that features described in relation to any of the embodiments described above can be applicable interchangeably between the different embodiments. The embodiments described above are examples to illustrate various features of the invention.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A riser assembly for transporting fluids from a sub-sea location, comprising:

a riser comprising at least one segment of flexible pipe;

two or more buoyancy elements connected to the at least one segment of flexible pipe for providing a positive buoyancy to a portion of the riser and to form a steep or lazy wave configuration; and two or more tethering elements connected to at least one of the buoyancy elements for tethering the at least one of the buoyancy elements to a fixed structure, the tethering elements in constant tension to thereby provide axial and lateral support to the riser, and to resist the positive buoyancy of the buoyancy elements;

wherein the buoyancy elements are sufficiently positively buoyant such that an upward force is created on the riser and such that, if the downward force or weight of the riser increases, there is sufficient upward force from the buoyancy elements to ensure the two or more tethering elements remain in constant tension, and wherein the two or more tethering elements are arranged to provide an opposite force to the upward force of the buoyancy elements.

2. The riser assembly as claimed in claim 1, wherein the fixed structure is an anchor weight on the sea bed.

3. The riser assembly as claimed in claim 1, wherein the fixed structure is a structure built on a pile foundation.

4. The riser assembly as claimed in claim 1, wherein the tethering elements are at least partly flexible.

5. The riser assembly as claimed in claim 1, wherein the tethering elements comprise a rope or chain connected to the buoyancy element.

6. The riser assembly as claimed in claim 1, wherein the tethering elements are provided at an apparent angle of about 5 to 15 degrees from vertical in a direction of the side view of the riser.

7. The riser assembly as claimed in claim 1, wherein the tethering elements are provided at an apparent angle of about 20 to 40 degrees from vertical in a direction when viewing a front view of the riser.

8. A method of supporting a flexible pipe, the method comprising:

providing a riser comprising at least one segment of flexible pipe;

providing two or more buoyancy elements connected to the at least one segment of flexible pipe for providing a positive buoyancy to a portion of the riser and to form a steep or lazy wave configuration; and providing two or more tethering elements connected to at least one of the buoyancy elements for tethering the at least one of the buoyancy elements to a fixed structure, the tethering elements in constant tension to provide axial and lateral support to the riser, and resisting the positive buoyancy of the buoyancy elements;

wherein the buoyancy elements are sufficiently positively buoyant such that an upward force is created on the riser and such that, if the downward force or weight of the riser increases, there is sufficient upward force from the buoyancy elements to ensure the two or more tethering elements remain in constant tension; and wherein the two or more tethering elements are arranged to provide an opposite force to the upward force of the buoyancy elements.

9. The method as claimed in claim 8, wherein the riser is provided at a desired location with the buoyancy elements attached thereto.

10. The method as claimed in claim 8, further comprising the step of attaching weight elements to one or more buoyancy elements prior to the step of tethering the buoyancy element to a fixed structure.

11. The method as claimed in claim 10, further comprising the step of releasing the weight elements after the step of tethering the buoyancy elements to a fixed structure.

12. The method as claimed in claim 8, further comprising arranging the riser and/or tethering elements to minimize interference with any neighboring riser or vessel structure.

13. The method as claimed in claim 8, wherein the tethering elements are at least partly flexible.

14. The method as claimed in claim 8, wherein the tethering elements comprise a rope or chain connected to the buoyancy element.

* * * * *